US008262819B2

(12) United States Patent
Briggs

(10) Patent No.: US 8,262,819 B2
(45) **Date of Patent: *Sep. 11, 2012**

(54) TOUGH, HIGH-STRENGTH TITANIUM ALLOYS; METHODS OF HEAT TREATING TITANIUM ALLOYS

(75) Inventor: Robert D. Briggs, Auburn, WA (US)

(73) Assignee: The Boeing Company, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/830,915

(22) Filed: Jul. 6, 2010

(65) Prior Publication Data

US 2010/0269958 A1 Oct. 28, 2010

Related U.S. Application Data

(63) Continuation of application No. 10/459,396, filed on Jun. 10, 2003, now Pat. No. 7,785,429.

(51) Int. Cl.
*C22F 1/18* (2006.01)
*C22C 14/00* (2006.01)

(52) U.S. Cl. ..... 148/669; 148/421; 420/421

(58) Field of Classification Search ..... 148/669, 148/421; 420/421

See application file for complete search history.

(56) References Cited

U.S. PATENT DOCUMENTS 2,880,089 A * 3/1959 Vordahl ..... 420/418
2,950,191 A 8/1960 Vordahl
2,968,586 A 1/1961 Vordahl
3,147,115 A 9/1964 Vordahl
3,741,819 A 6/1973 Chollet
4,098,623 A 7/1978 Ibaraki et al.
4,134,758 A 1/1979 Nagai et al.
4,631,092 A 12/1986 Ruckle et al.
4,975,125 A * 12/1990 Chakrabarti et al. ..... 148/407
5,407,787 A 4/1995 McElhanon et al.
5,460,774 A 10/1995 Bachelet
5,698,050 A 12/1997 El-Soudani
6,454,882 B1 9/2002 Martin (Continued)

FOREIGN PATENT DOCUMENTS

EP 0843021 A1 5/1998

(Continued)

OTHER PUBLICATIONS

W.D. Brewer et al., "Titanium alloys and processing for high speed aircraft", Materials Science and Engineering, A243 (1998) pp. 299-304.*

(Continued)

*Primary Examiner* — Jessee R. Roe
(74) *Attorney, Agent, or Firm* — Perkins Coie LLP

(57) ABSTRACT

The present disclosure describes methods of heat treating Ti-based alloys and various improvements that can be realized using such heat treatments. In one exemplary implementation, the invention provides a method of forming a metal member that involves forming an alloy into a utile shape and cooling the alloy from a first temperature above a beta transus temperature of the alloy to a second temperature below the beta transus temperature at a cooling rate of no more than about 30° F./minute. If so desired, the alloy my be treated for a period of about 1-12 hours at about 700-1100° F. Titanium alloys treated according to aspects of the invention may have higher tensile strengths and higher fracture toughness than conventional wrought, mill-annealed Ti 64 alloy.

16 Claims, 5 Drawing Sheets

U.S. PATENT DOCUMENTS

2004/0250932 A1 12/2004 Briggs et al.

FOREIGN PATENT DOCUMENTS

| | | | |
|---|---|---|---|
| EP | 1078997 | A1 | 2/2001 |
| GB | 710584 | A | 6/1954 |
| GB | 815975 | A | 7/1959 |
| GB | 1449134 | A | 9/1976 |
| SU | 396427 | A1 | 8/1973 |

OTHER PUBLICATIONS

Davis et al., ASM Handbook, 1995, ASM International vol. 4., pp. 913-923.

Davis et al., ASM Handbook, 1996, ASM International vol. 2., pp. 608-610.

European Search Report for Application No. EP 04 07 6736, 4 pgs, Sep. 30, 2004, European Patent Office.

Gil, F.J. et al., "The effect of cooling rate on the cyclic deformation of beta-annealed-6A1-4V," Materials Science & Engineering, A: Structural Materials: Properties, Microstructure and Processing, A349(1-2), 150-155 Coden:MSAPE3; 2003.

Legkodukh et al., Properties of High-Strength Titanium Alloys After Hydrostatic Extrusion, 1976, Metallovedenie I Termcheskaya Obtabotka Metallov, No. 3, pp. 74-76.

Lutjering et al., James C. Titanium, Springer—Verland., pp. 177-201, Online version available at: http://www.knovel2/Toc.jsp?BookID=1116&VerticalID=0.

Military Specification, "Heat Treatment of Titanium and Titanium Alloys," Sep. 12, 1968.

SAE, The Engineering Society of Advancing Mobility Land Sea Air and Space International, Aerospace Material Specification, "Heat Treatment of Titanium Alloy Parts," Copyright 1994, Society of Automotive Engineers, Inc. (16 pages).

Sridhar, G. et al., "The influence of heat treatment on the structure and properties of a near-.alpha. titanium alloy," Metallurgical Transactions A: Physical Metallurgy and Material Science, 18A(5), 877-91, Coden: MTTABN; 1987.

Tetyukhin, Vladislav, Current State of Russian Titanium Industry and VSMPO; Development of New High Strength Alloys for Aircraft and Civil Engineering Proceedings of the 1997 International Conference on Titanium Products and Applications, Copyright 1998 by the International Titanium Association (6 pages).

Thompson, Anthony W., "The Effect of Microstructure on Fatigue Crack," Titanium and Titanium Alloys Scientific and Technological Aspects, Edited by J.C. Williams and A.F. Belov, 1982 Plenum Press (pp. 691-704).

* cited by examiner

TOUGH, HIGH-STRENGTH TITANIUM ALLOYS; METHODS OF HEAT TREATING TITANIUM ALLOYS

CROSS-REFERENCE TO RELATED APPLICATION

This is a continuation application of U.S. patent application Ser. No. 10/459,396, filed Jun. 10, 2003, entitled TOUGH, HIGH-STRENGTH TITANIUM ALLOYS; METHODS OF HEAT TREATING TITANIUM ALLOYS, now U.S. Pat. No. 7,785,429, which is herein incorporate by reference in its entirety.

TECHNICAL FIELD

The present invention relates to titanium metallurgy. The invention relates more particularly to processes for treating titanium alloys to enhance physical and mechanical properties of the alloys, such as tensile strength and fracture toughness. Aspects of the invention have particular utility in connection with light, high-strength structures, e.g., structural members for aircraft.

BACKGROUND

Titanium alloys are frequently used in aerospace and aeronautical applications because of their superior strength, low density, and corrosion resistance. Titanium and many titanium alloys exhibit a two-phase behavior. Pure titanium exists in an alpha phase having a hexagonal close-packed crystal structure up to its beta transus temperature (about 1625° F.). Above the beta transus temperature, the microstructure changes to the beta phase, which has a body-centered-cubic crystal structure. Pure titanium is unduly weak and too ductile for use in most aerospace and aeronautical applications, though. To achieve the necessary strength and fatigue resistance, titanium is typically alloyed with other elements.

Certain alloying elements may affect the behavior of the crystal structure, allowing the beta phase to be at least metastable at room temperature. Alpha-beta alloys are typically made by adding one or more beta stabilizers, e.g., vanadium, that inhibit the transformation from beta to alpha and allow the alloy to exist in a two-phase alpha-beta form at room temperature.

The two most prevalent titanium alloys in use in aerospace and aeronautical applications are likely Ti 64 and Ti 6242. Both of these alloys are titanium-based alloys, i.e., at least about 50% of the alloy comprises titanium. Ti 64 is an alpha-beta alloy that consists principally of about 6 weight percent (wt. %) aluminum, 4 wt. % vanadium, and the balance titanium and incidental impurities. Ti 6242 is also an alpha-beta alloy and it consists principally of about 6 wt. % aluminum, 2 wt. % tin, 4 wt. % zirconium, 2 wt. % molybdenum, and the balance titanium and incidental impurities.

Beta and alpha-beta titanium alloys are known to be sensitive to the cooling rate when cooled from a temperature above the beta transus temperature. FIG. 1 is photomicrograph (taken at 200× magnification) of a beta-annealed Ti 64 plate. FIG. 2 is a photomicrograph (also taken at 200× magnification) of a Ti 6242 casting. Both of these microstructures exhibit a relatively coarse "basketweave" of alpha and beta crystals. The basketweave is coarser in the Ti 6242 alloy (FIG. 2). Alpha phase is also precipitated at the grain boundaries in both alloys during cooling. This alpha precipitation significantly decreases ductility and reduces fatigue strength of the alloy.

To achieve a commercially acceptable titanium alloy, it is well known in the art that the alloy must be cooled very quickly to limit the precipitation of alpha phase at the grain boundaries. For this reason, conventional wisdom dictates that beta and alpha-beta alloys such as Ti 64 and Ti 6242 must be quenched rapidly if heated to or above the beta transus temperature. Typically, the rapid cooling is at least as fast as air cooling. Alpha-beta titanium alloys are also frequently cooled even faster, e.g., with a gas, water, or oil quench. It has been suggested that cooling rates in the range of 700-1200° F. per minute are optimal to maintain creep and low-cycle fatigue of alpha-beta Ti 6242S (which comprises Ti 6242 with the addition of a minor fraction, e.g., 0.09 wt. %, of silicon), for example. (See, e.g., U.S. Pat. No. 5,698,050, the entirety of which is incorporated herein by reference.)

Even if titanium alloys are heated to a temperature below the beta transus temperature, common knowledge dictates that the alloy should be cooled rapidly to maintain acceptable mechanical properties. For example, the United States Department of Defense has published specifications for the heat treatment of titanium alloys under Military Specification MIL-H-81200B, the entirety of which is incorporated herein by reference. In this military specification, all beta and alpha-beta titanium alloys are air-cooled, cooled with an inert gas, or quenched with water or oil; furnace cooling is specifically prohibited. The specifications further set forth maximum delay times of 10 seconds or less to initiate quenching to avoid undue precipitation of grain boundary alpha phase. Aerospace Material Specification AMS 4919B provides similar admonitions regarding cooling rates for beta and alpha-beta titanium alloys.

The need to rapidly quench beta and alpha-beta titanium alloys can limit their use in some structural applications. For example, the properties of alpha-beta titanium alloys can drop off significantly as the thickness of a cast or forged part increases. This is due, at least in part, to the differential cooling rate between the outer portions and the inner portions of the formed structure. For Ti 64 alloys, for example, the tensile strength and fracture resistance for cast or forged parts drops significantly in areas having a thickness of five inches or more. To compensate for the drop-off in mechanical properties, the thick parts of a cast or forged Ti 64 member must be made even thicker, both exacerbating the cooling rate difficulties and increasing the weight and cost of the final finished part.

DETAILED DESCRIPTION

A. Overview

Figure 1:
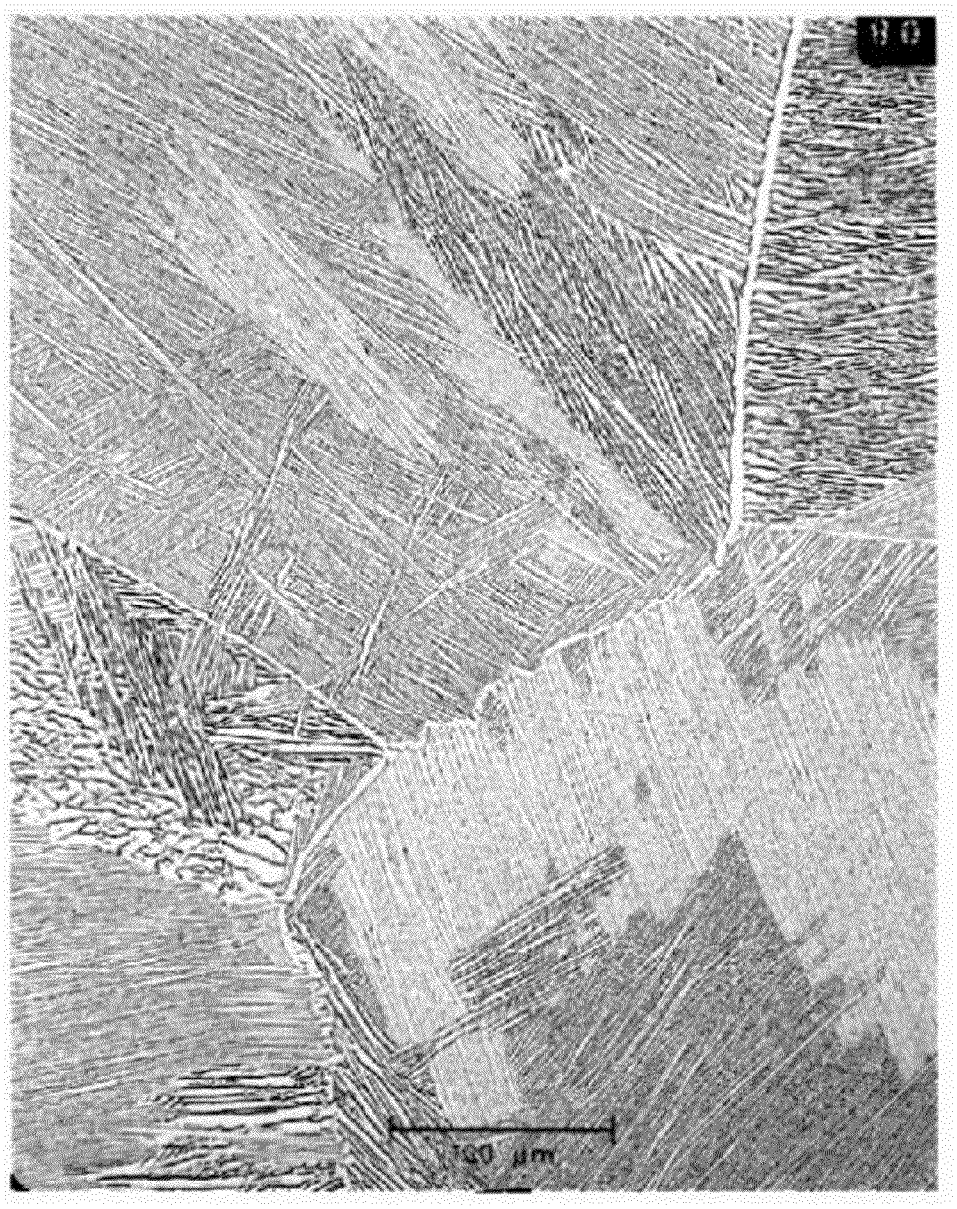
Fig. 1 (Prior Art)
FIG. 1 is a photomicrograph taken at 200× magnification of a conventionally processed beta-annealed Ti 64 plate.

Various embodiments of the present invention provide methods for heat treating titanium alloys and metal members comprising heat-treated titanium alloys, e.g., cast or forged titanium alloy parts. Aspects of the invention show significant promise as viable alternatives to conventional wrought Ti 64 and Ti 6242, likely the most common titanium alloys in the aircraft industry today.

One embodiment of the invention provides a method of forming a metal member in which an alloy is formed into a utile shape. The alloy may comprise at least about 50 wt. % titanium and at least about 5 wt. % molybdenum. The alloy is cooled from a first temperature above a beta transus temperature of the alloy to a second temperature below the beta transus temperature at a cooling rate of no more than about 5° F. per minute. Thereafter, the alloy optionally may be treated for a period of about 1-12 hours at a third temperature of about 700-1100° F.

A method of forming a metal member in accordance with another embodiment of the invention involves forming an alloy into a utile shape. The alloy may comprise at least about 50 wt. % titanium and at least about 5 wt. % molybdenum. The alloy is cooled from a first temperature above a beta transus temperature of the alloy to room temperature at a cooling rate of no more than about 30° F. per minute. Thereafter, the alloy optionally may be treated for a period of about 1-12 hours at a third temperature of about 700-1100° F.

Another embodiment of the invention provides a method of heat treating a titanium-based alloy that comprises cooling the alloy from a first temperature above a beta transus temperature of the alloy to a second temperature below the beta transus temperature. This cooling may take place at a rate of less than 30° F. per minute, e.g., about 1-5° F. per minute.

A method of manufacturing an aircraft in accordance with another embodiment of the invention comprises forming a structural member and assembling the structural member into the aircraft. Forming the structural member may include forming an alloy into a utile shape, the alloy comprising at least about 50 wt. % titanium and at least about 5 wt. % molybdenum. The alloy may be cooled from a first temperature above a beta transus temperature of the alloy to a second temperature below the beta transus temperature at a cooling rate of no more than about 30° F. per minute. When assembled into the aircraft, the structural member may be in a load-bearing position in the aircraft and have an ultimate tensile strength of at least about 150 ksi and a $K_{1C}$ fracture toughness of at least about 70 ksi√in.

For ease of understanding, the following discussion is subdivided into two areas of emphasis. The first section outlines methods for heat treating titanium alloys in accordance with embodiments of the invention. The second section discusses specific applications for formed metal members in accordance with other aspects of the invention.

B. Methods of Heat Treating Ti Alloys

FIG. 1 schematically illustrates a heat treatment method 100 in accordance with an embodiment of the invention. In accordance with this method 100, a titanium-based alloy may be provided in any desired form. The titanium-based alloy is desirably either a beta titanium alloy or an alpha-beta titanium alloy, i.e., a titanium alloy that will exhibit both alpha and beta phases at room temperature. As discussed in more detail below, in select embodiments of the invention the alloy comprises at least about 50 wt. % titanium and at least about 5 wt. % molybdenum.

The form in which the alloy is provided will depend in large part on the intended use of the alloy. In one embodiment, the alloy is formed into a utile shape before the heat treatment. For example, the alloy may be forged into the desired shape. As is known in the art, such forging will typically will take place at a temperature below the beta transus temperature. Alternatively, the alloy may be formed into a utile shape by various casting techniques. In one embodiment, the casting may take place at a temperature above the beta transus temperature for the alloy and the cast part may be subjected to the slow cool process 120 (discussed below) in cooling down from the initial casting. In other embodiments, the casting may be cooled to a temperature below the beta transus temperature for hot isostatic pressing or the like.

If the alloy is presented at a temperature that is below the beta transus temperature, it may be heated above the beta transus temperature in the heating process 110 of FIG. 3. The beta transus temperature of the alloy may be determined using conventional techniques, e.g., by testing representative samples from a lot of the alloy in accordance with MIL-H-81200B, mentioned above. In one embodiment, the alloy is soaked at a temperature that is about 50±25° F. above the determined beta transus temperature of the lot. In one embodiment, the soaking time is selected such that all portions of the alloy member are soaked at the target temperature for at least 30 minutes. This time may vary with the selected soak temperature, with soaking times decreasing with increasing temperature.

After the alloy has been subjected to the heat process 110, it may be cooled in the slow cool process 120. This slow cool process 120 desirably takes place at a cooling rate that is substantially lower than conventional wisdom would dictate. As noted above, it is widely accepted that cooling of a beta-annealed beta or alpha-beta titanium alloy should be cooled at least as fast as air cooling, e.g., at a rate of about 700-1200° F. for Ti 6242S. In contrast, cooling rates in the slow cool process 120 are desirably no greater than 30° F. and may be less than 30° F. In one embodiment, the alloy is cooled in the slow cool process 120 at a rate of about 1-30° F. per minute, e.g., about 1-10° F. per minute. It has been found that the tensile strength and fracture toughness of at least some beta and alpha-beta alloys may be further enhanced by a particularly slow cooling rate. Hence, in further embodiments of the invention, the cooling rate in the slow cool process 120 is no more than about 5° F. per minute, e.g., 1-5° F., with select embodiments being cooled at about 1-2° F. per minute.

Such slow cooling rates are counterintuitive given the consistent teachings in the art that beta and alpha-beta titanium alloys must be cooled quickly from beta anneal temperatures to maintain acceptable ductility and fracture toughness. As highlighted in some of the experimental examples below, a slow cool process 120 at a slow cooling rate, e.g., less than 30° F. per minute, can yield strong, tough alloys. For example, select embodiments of the invention provide a heat-treated alloy having ultimate tensile strength of at least about 150 ksi and a $K_{1C}$ fracture toughness of at least about 70 ksi√in.

The slow cool process 120 starts from a temperature above the beta transus temperature and continues to a second temperature that is below the beta transus temperature. In one embodiment, this second temperature is no greater than about 1500° F., e.g., 1400° F. or less. In other embodiments of the invention, this second temperature is less than about 250° F. As explained below in connection with some of the experimental examples, continuing the slow cool process 120 until the alloy reaches room temperature, typically less than 100° F., will yield particularly good results.

If the slow cool process 120 stops at an intermediate second temperature that is less than the beta transus temperature, but greater than room temperature, it may be subjected to a final cool process 130. In this final cool process 130, the temperature is reduced from the second temperature to room temperature at a cooling rate that is faster than the cooling rate in the slow cool process 120. In one embodiment, for example, the final cool process 130 comprises allowing the alloy to cool from the second temperature to room temperature by air-cooling the alloy. If so desired, the alloy may be cooled even faster, e.g., by quenching with an inert gas, water, or oil. Such a final cool process 130 can increase throughput of the heat treatment method 100 while achieving mechanical properties that may still surpass those conventionally obtained for Ti 64 and Ti 6242 alloys.

Certain embodiments of the invention include an optional reheating process 140 in which the alloy is treated at an elevated temperature below the beta transus temperature. The temperature of the reheating process 140 and the soak time at the desired temperature may vary depending on the composition of the alloy and its desired properties, among other factors. Generally, though, such a reheating process 140 may comprise maintaining the alloy at a temperature of at least 700° F. but below the beta transus temperature for a period of at least one hour. In select embodiments, the reheating process 140 may comprise heat treating the alloy at a temperature of about 700-1100° F. for about 1-12 hours. Although temperatures higher than 1100° F. may reduce the time needed in the reheating process to achieve a desired property, temperatures in excess of 1100° F. are not believe to be necessary for most alloys.

Once the alloy has spent a sufficient soak time at the intended elevated temperature in the reheating process 140, it may be cooled down to room temperature. Although a slow cooling rate, e.g., 30° F. per minute or less, is typically used, substantially faster cooling rates may be used. In one embodiment, the alloy is cooled fairly rapidly after soaking at the intended reheating temperature, e.g., by air cooling or quenching.

Figure 2:
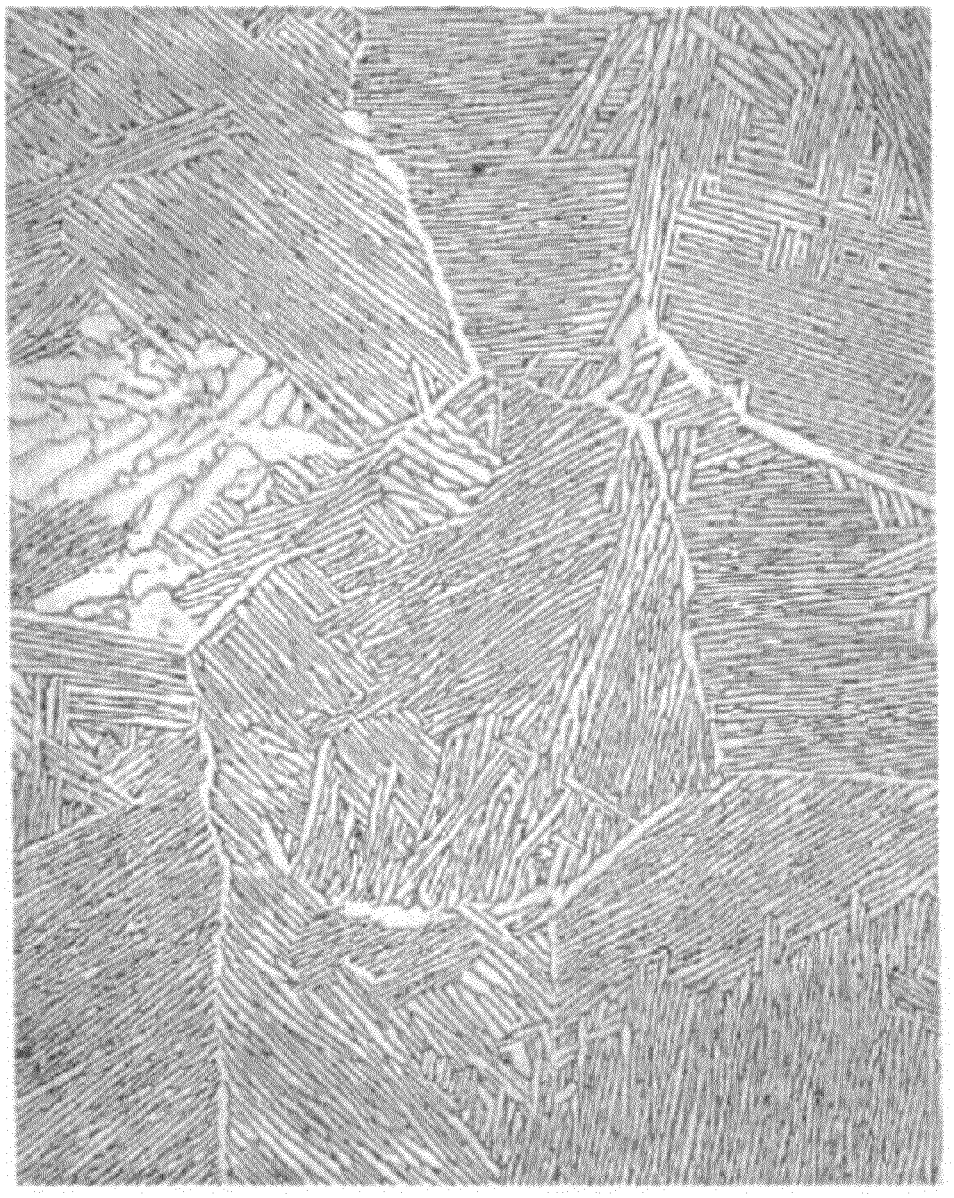
Fig. 2 (Prior Art)
FIG. 2 is a photomicrograph taken at 200× magnification of a conventionally processed Ti 6242 casting.
Figure 4:
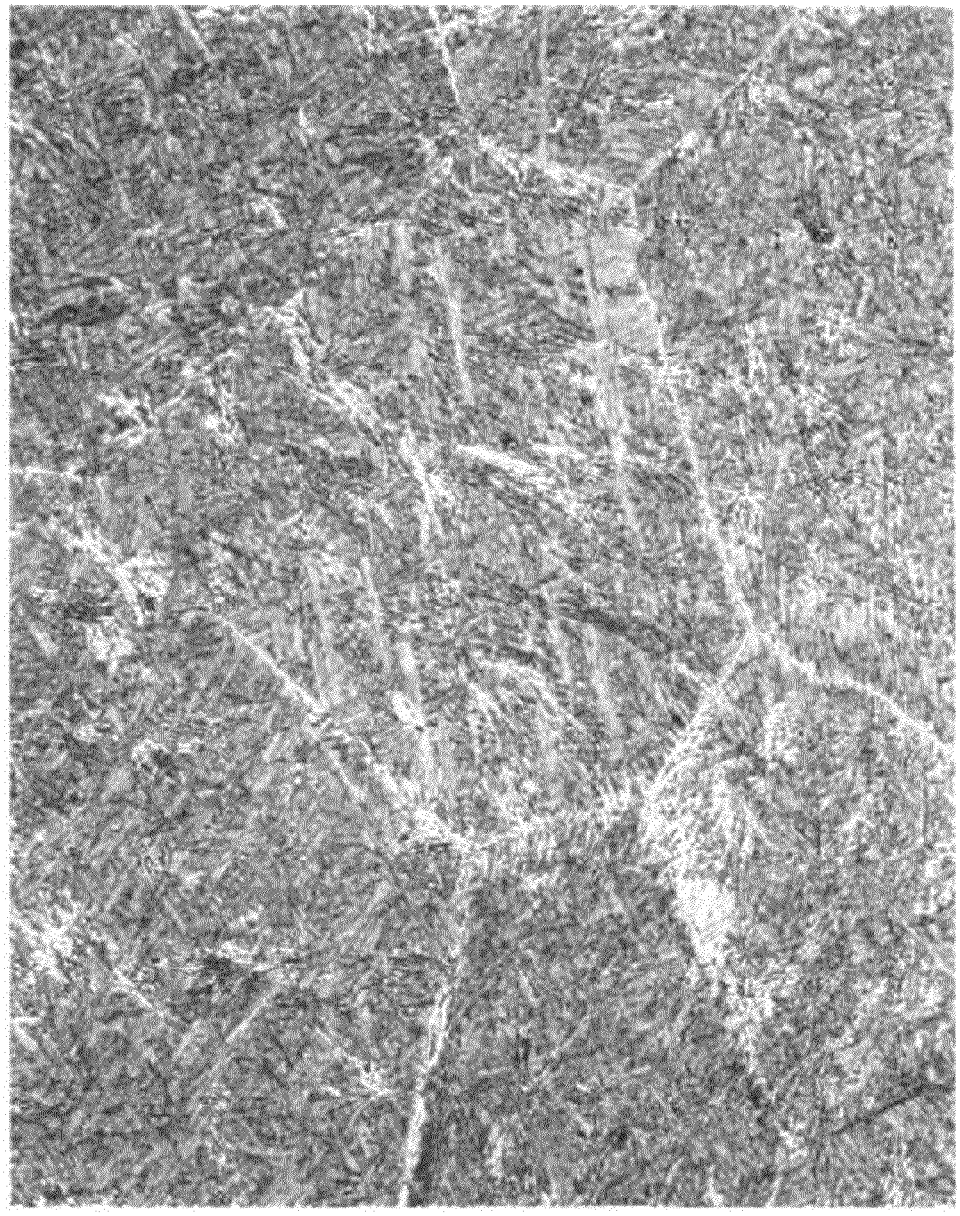
FIG. 4 is a photomicrograph taken at 200× magnification of a Ti 5553 alloy heat treated in accordance with an embodiment of the invention.

FIG. 4 is a photomicrograph of an alpha-beta titanium alloy heat treated in accordance with an embodiment of the invention. The particular alloy shown in FIG. 4 comprises Ti 5553 (also referred to as VT 22-1) which comprises principally about 5 wt. % aluminum, 5 wt. % molybdenum, 5 wt. % vanadium, and 3 wt. % chromium, with the balance comprising titanium and minor impurities. Comparing the photomicrograph of FIG. 4 with FIGS. 1 and 2, which were also taken at 200× magnification, highlights the significant differences in microstructure between conventional titanium alloy heat treatment and heat treatment in accordance with embodiments of the present invention. FIGS. 1 and 2 illustrate relatively coarse basketweave structures of long, relatively large alpha inclusions in a beta structure. A fair amount of the alpha structure is also precipitated at the grain boundaries in FIGS. 1 and 2. The structure shown in FIG. 4, in contrast, has an extremely fine basketweave structure that includes fine, acicular alpha phase and very little grain boundary alpha. This is particularly surprising in light of the common understanding in the art that beta and alpha-beta titanium alloys must be cooled very rapidly to avoid undue precipitation of grain boundary alpha phase.

EXPERIMENTAL EXAMPLES

Aspects of the present invention are highlighted and exemplified in the following experimental examples. These examples are intended to be illustrative, not restrictive, in nature and are not intended to narrow the scope of the invention.

Example 1

Table 1 compares the effects of various heat treatments on yield strength, ultimate tensile strength, elongation, and fracture toughness. Thirteen samples (identified as samples A1-A13) of a Ti 5553 alloy (nominal composition of about 5 wt. % Al, 5 wt. % Mo, 5 wt. % V, 3 wt. % Cr, and balance Ti and impurities) were prepared. Each of samples A1-A12 was soaked at a temperature above the beta transus temperature for a time deemed sufficient to convert the sample to beta phase, then cooled at a rate of 1° F./min. or 2° F./min. to room temperature, 1400° F., or 1500° F. Some of the samples were subjected to a reheating process 140 (FIG. 3) in which they were soaked for about 8 hours at a temperature of about 1100° F. Those samples cooled to an elevated intermediate temperature of 1400° F. or 1500° F. and aged (samples A3, A5, A9, and A11) were air cooled to room temperature upon reaching the intermediate temperature; those cooled to an elevated intermediate temperature and not aged (A4, A6, A10, and A12) were held at the intermediate temperature for four hours then allowed to air cool.

As a point of comparison, sample A13 was heat treated in a fashion one skilled in the art might suggest to achieve a high ultimate tensile strength and high fracture toughness. In particular, sample A13 was soaked at a temperature of about 20° C. below the beta transus temperature for about 4 hours, furnace cooled to 1454° F. and held for 3 hours then air cooled to room temperature, and then aged at 1150° F. for 8 hours.

TABLE 1

| Sample | Cool Rate (° F./min.) | End of Slow Cool (° F.) | Age Temp (° F.) | Yield Strength (ksi) | Ultimate Strength (ksi) | Elongation (%) | Fracture Toughness $K_{1C}$ (ksi√in) |
|---|---|---|---|---|---|---|---|
| A1 | 1 | RT | 1100 | 142 | 159 | 10 | 89.1 |
| A2 | 1 | RT | N/A | 137 | 151 | 16.1 | 81.2 |
| A3 | 1 | 1400 | 1100 | 197 | 199 | 3.8 | 41.4 |
| A4 | 1 | 1400 | N/A | 121 | 128 | 16.9 | 67.2 |
| A5 | 1 | 1500 | 1100 | ** | ** | ** | 34.3 |
| A6 | 1 | 1500 | N/A | 108 | 118 | 6.9 | 62.6 |
| A7 | 2 | RT | 1100 | 145 | 162 | 15.2 | 79.8 |
| A8 | 2 | RT | N/A | 143 | 155 | 13.8 | 73.3 |
| A9 | 2 | 1400 | 1100 | ** | ** | ** | 43.8 |
| A10 | 2 | 1400 | N/A | 126 | 134 | 18.3 | 86.8 |
| A11 | 2 | 1500 | 1100 | ** | ** | ** | 33.6 |
| A12 | 2 | 1500 | N/A | 108 | 121 | 8.6 | 56.9 |
| A13 | >>30 | 1454 | 1150 | 167 | 182 | 7.1 | 46.6 |

*** Samples A5, A9, and A11 broke during tensile testing before data was collected.

The results in Table 1 suggests that slow cooling the alpha-beta Ti 5553 sample to room temperature in accordance with aspects of the invention can significantly improve the balance of tensile strength and toughness. The sample treated in accordance with common wisdom, sample A13, exhibited tensile strengths somewhat higher than the samples slow cooled to room temperature in accordance with the present invention (samples A1, A2, A7, and A8). However, sample A13 was much less ductile (7.1% elongation) and less tough ($K_{1C}$ fracture toughness of less than 47 ksi√in) than any one of samples A1, A2, A7, and A8 (elongation of 10-16.1%, $K_{1C}$ fracture toughness of at least 73 ksi√in and as high as 89.1 ksi√in). Cooling at about 1 or 2° F./min to an intermediate temperature of 1400-1500° C. did not appear to yield significant benefit over the more conventional treatment of sample A13.

Example 2

The impact of a reheat process 140 (FIG. 3) after beta annealing were analyzed. In addition, both reheated and non-reheated samples treated in accordance with aspects of the invention were compared to results obtained using a conventional annealing process. Table 2 lists the results of this testing.

TABLE 2

| Sample | Heat Treatment | Avg. Yield Strength (ksi) | Ultimate Strength (ksi) | Elongation (%) | Fracture Toughness K1C (ksi√in) |
|---|---|---|---|---|---|
| B1 | β anneal, slow cool, no reheat | 143 | 156 | 13.0 | 74.4 |
| B2 | β anneal, slow cool, and reheat | 147 | 158 | 12.3 | 77.3 |
| B3 | sub-β anneal, air cool, and age | 180 | 189 | 8.8 | 36.6 |

All three samples were Ti 5553 alloy. The first two samples, B1 and B2, were heated above the beta transus temperature and cooled at a rate of about 2° F./min to room temperature. Sample B2 was then reheated to about 1100° F. and held at that temperature for about 8 hours; B1 was tested without a subsequent reheat process 140 (FIG. 3). The third sample, sample B3, was heat treated more conventionally by annealing at a temperature about 100° F. below the beta transus temperature, then air cooling to a temperature of about 1100° F.) and aging at that temperature before testing.

The sample subjected to a conventional air cooling process, sample B3, had yield and ultimate tensile strengths of 180 ksi or greater, but this conventional sample was quite brittle, with a $K_{1C}$ fracture toughness of less than 37 ksi√in. Although the slow-cooled samples B1 and B2 had lower tensile strengths, their fracture toughness was more than double that of sample B3. This makes them much better suited for some applications, e.g., load-bearing members in aircraft, than the conventional heat treatment.

Figure 3:
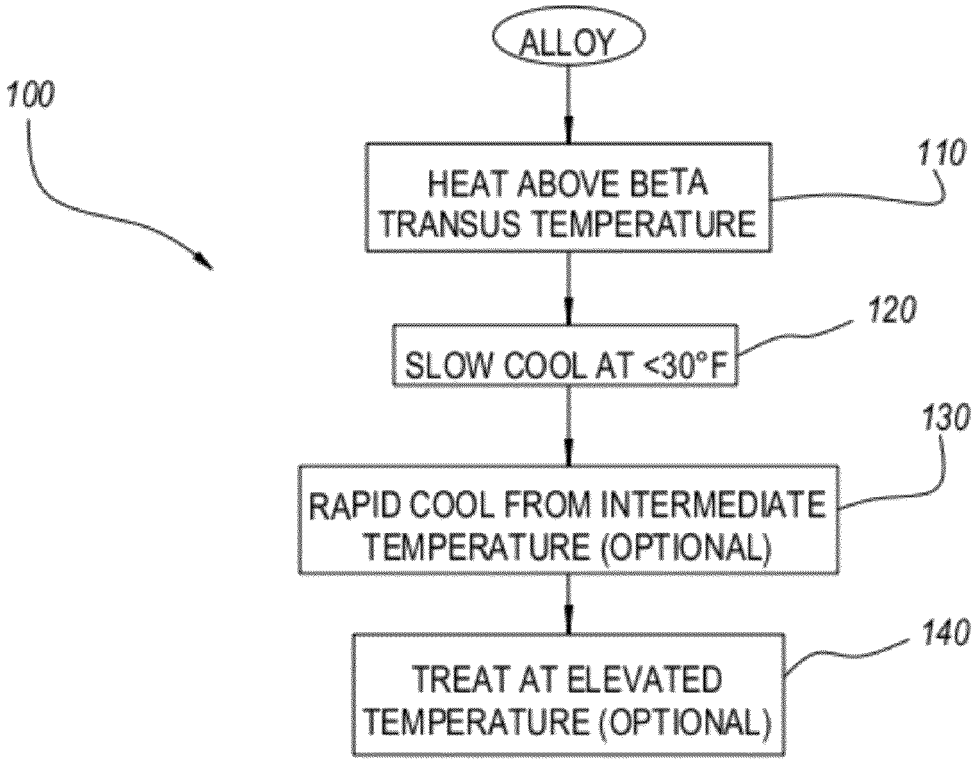
FIG. 3 is a flowchart schematically illustrating aspects of a heat treatment in accordance with an embodiment of the invention.

Table 2 also highlights a surprising result of the reheating process 140 (FIG. 3). Instead of sacrificing strength for improved toughness, as one might expect, the reheating process 140 increased toughness and increased the yield and ultimate strength of sample B2.

Example 3

Although the slow cooling process 120 (FIG. 3) appears to provide some advantage for a number of beta and alpha-beta titanium alloys, the advantages are more pronounced for alloys comprising more than 2 wt. % molybdenum. Table 3 lists strength and toughness measurements for four different samples, C1-C4, each of which was heated to a temperature above its beta transus temperature and cooled at a rate of about 2° F./min to about 1100° F., held at about 1100° F. for about 8 hours, then allowed to air cool to room temperature.

TABLE 3

| Sample | Alloy | Avg. Yield Strength (ksi) | Ultimate Strength (ksi) | Elongation (%) | Fracture Toughness K1C (ksi√in) |
|---|---|---|---|---|---|
| C1 | Ti 5Al—5Mo—5V—1Cr—1Fe (VT22) | 129 | 142 | 13.5 | 110.0 |
| C2 | Ti 15Mo—3Al—2.7Nb (Beta 21S) | 152 | 165 | 9.5 | 81.4 |
| C3 | Ti 10V—2Fe—3Al | 111 | 125 | 18.5 | 120.0 |
| C4 | Ti 4.5Al—3V—2Mo—2Fe (SP700) | 113 | 132 | 16.0 | **** |

*** Fracture toughness of sample C4 was not measured but would be expected to be relatively high given the ductility suggested by the 16% elongation measurement at fracture in the tensile test.

Samples C3 and C4 exhibit good ductility, but have yield tensile strengths of less than 115 ksi and ultimate tensile strengths of 132 ksi or less. Although adequate for some purposes, similar results may be obtained using wrought and mill annealed Ti 64, a titanium alloy used in aerospace applications. Sample C3 has no molybdenum and sample C4 has only 2 wt. % molybdenum. The other two samples, each of which had in excess of 2 wt. % molybdenum, exhibited a much better balance of strength and toughness than samples C3 and C4. Samples B1 and B2 in Table 2, like samples C1 and C2 in Table 3, have at least 5 wt. % molybdenum. All four of these samples have tensile strengths superior to those measured for C3 and C4, suggesting that a slow cooling process 120 (FIG. 3) in accordance with the invention is particularly beneficial for titanium alloys containing at least 5 wt. % molybdenum.

Example 4

The effect of cooling rates in the slow cool process 120 (FIG. 3) were analyzed for samples of a Ti 5553 alloy and Table 4 lists the results. Each sample was heated to a temperature above its beta transus temperature, cooled to room temperature at the specified cooling rate, then reheated to 1100° F. for about 8 hours and air cooled.

TABLE 4

| Sample | Cooling Rate (° F./hr) | Yield Strength (ksi) | Ultimate Strength (ksi) | Elongation (%) | Fracture Toughness K1C (ksi√in) |
|---|---|---|---|---|---|
| D1 | 60 | 142 | 155 | 10.5 | 76.7 |
| D2 | 500 | 159 | 172 | 9.0 | 72.2 |
| D3 | 1000 | 160 | 174 | 8.0 | 73.2 |
| D4 | 2000 | 175 | 186 | 3.0 | 47.9 |

Sample D4, which was cooled at a rate of about 33° F./min (2000° F./hour), showed a rather substantial drop off in both ductility and fracture toughness, dropping from over 73 ksi√in (sample D3, cooled at about 17° F./min) to less than 48 ksi√in. Such low fracture toughness would render sample D4 unsuitable for many load-bearing members in aeronautical and aerospace applications, for example. The results for samples D1-D3 indicate that slow cooling rates of no more than 30° F./min, e.g., less than 17° F./min, are more appropriate, at least for aeronautical and aerospace applications.

Table 4 also suggests that ductility and fracture toughness can be improved at slower cooling rates, although this may sacrifice some tensile strength. For applications seeking higher tensile strengths, a cooling rate of greater than about 1° F./min but less than about 30° F./min—e.g., between about 8° F./min (500° F./hr) and about 17° F./min (1000° F./hr)—may provide a superior balance of tensile strength, ductility, and fracture toughness.

Example 5

Most thicker titanium-based parts in aerospace applications today comprise wrought Ti 64. Such parts are typically formed at a temperate about 50-100° F. below the beta transus temperature and mill annealed, e.g., in accordance with the mill anneal process set forth in Military Specification MIL-H-81200B. Typical ultimate tensile strength for wrought Ti 64 is generally on the order of about 130-140 ksi, with $K_{1C}$ fracture toughness typically in the vicinity of about 50 ksi·in.

Given the elevated temperature forming process and subsequent machining necessary to yield a finished part, a wrought Ti 64 part is appreciably more costly than a part cast from the same alloy. Unfortunately, the minimum requirements for cast parts are generally higher than those for forged parts because different locations on cast parts usually experience more significant variations in cooling rate than the same locations on a similar wrought part. The United States Federal Aviation Administration (FAA), for example, specifies that cast parts must include a safety factor of 25%, i.e., the projected maximum load carrying capacity for a part is reduced by 25% to determine whether it meets the specified requirement for the part. For example, if the specification calls for a part having a maximum load carrying capacity of 60 ksi, a cast part would have to have a nominal maximum capacity of 80 ksi (80 ksi less 25% is 60 ksi).

To test the viability of casting large parts from Ti alloys heat treated in accordance with aspects of the present invention a test part having an irregular shape and a maximum thickness of about 0.75 in. was cast. The cast part was formed in a mold then hot isostatic pressed at about 1650° F. at a pressure of about 15 ksi for about 2 hours to improve density. This cast part was then heated above the beta transus temperature and slow cooled (process 120 in FIG. 3) and reheated (process 140 in FIG. 3) in accordance with aspects of the invention. The alloy in this cast part exhibited an ultimate tensile strength of about 168 ksi. Once reduced by the 25% safety factor noted above, the effective ultimate tensile strength for use in parts design would be about 126 ksi. This compares favorably to the 130 ksi-140 ksi ultimate tensile strength typical for wrought Ti 64, meaning that a cast and heat-treated part in accordance with embodiments of the invention need only be slightly thicker (e.g., 5% thicker) than a wrought Ti 64 part to meet the same design specifications. Manufacturing costs for cast parts are typically less than those for wrought parts, so the ability to cast parts instead of using conventional wrought Ti 64 may enable significant cost savings that would more than offset the requirement for a marginally thicker part.

Heat treating forged parts in accordance with aspects of the invention can also yield significant benefits over conventional wrought Ti 64 parts. To demonstrate the efficacy of heat treatment methods 100 in accordance with the invention for forged parts, the main landing gear beam for a BOEING 747, which is 10 inches thick in some areas, was forged from Ti 5553, heated above the beta transus temperature, and slow cooled and reheated in accordance with aspects of the invention. The ultimate tensile strength of a conventional air-cooled wrought Ti 64 alloy in areas 10 inches thick may be expected to be quite poor. With great care, it may be able to achieve ultimate tensile strengths for such a 10 inch-thick area on the order of about 130 ksi. A 10-inch thick area of the test casting of the main landing gear beam exhibited an ultimate tensile strength over 158 ksi and fracture toughness over 75 ksi√in, though. Accordingly, a titanium-based alloy part manufactured in accordance with embodiments of the invention would be significantly stronger, and likely more durable, than a typical wrought Ti 64 part of the same dimensions. Alternatively, a part heat treated in accordance with aspects of the present invention may be thinner and lighter than a wrought Ti 64 part for the same application.

C. Specific Applications

Metal members manufactured in accordance with embodiments of the invention may find use in any circumstance calling for a light, strong, and tough material. Such metal members may be used as load-bearing structural members, e.g., in aerospace and aeronautical applications. As noted above, aspects of the invention provide methods of manufacturing an aircraft, which methods may involve a heat treatment similar to the heat treatment method 100 outlined in FIG. 3.

Figure 5:
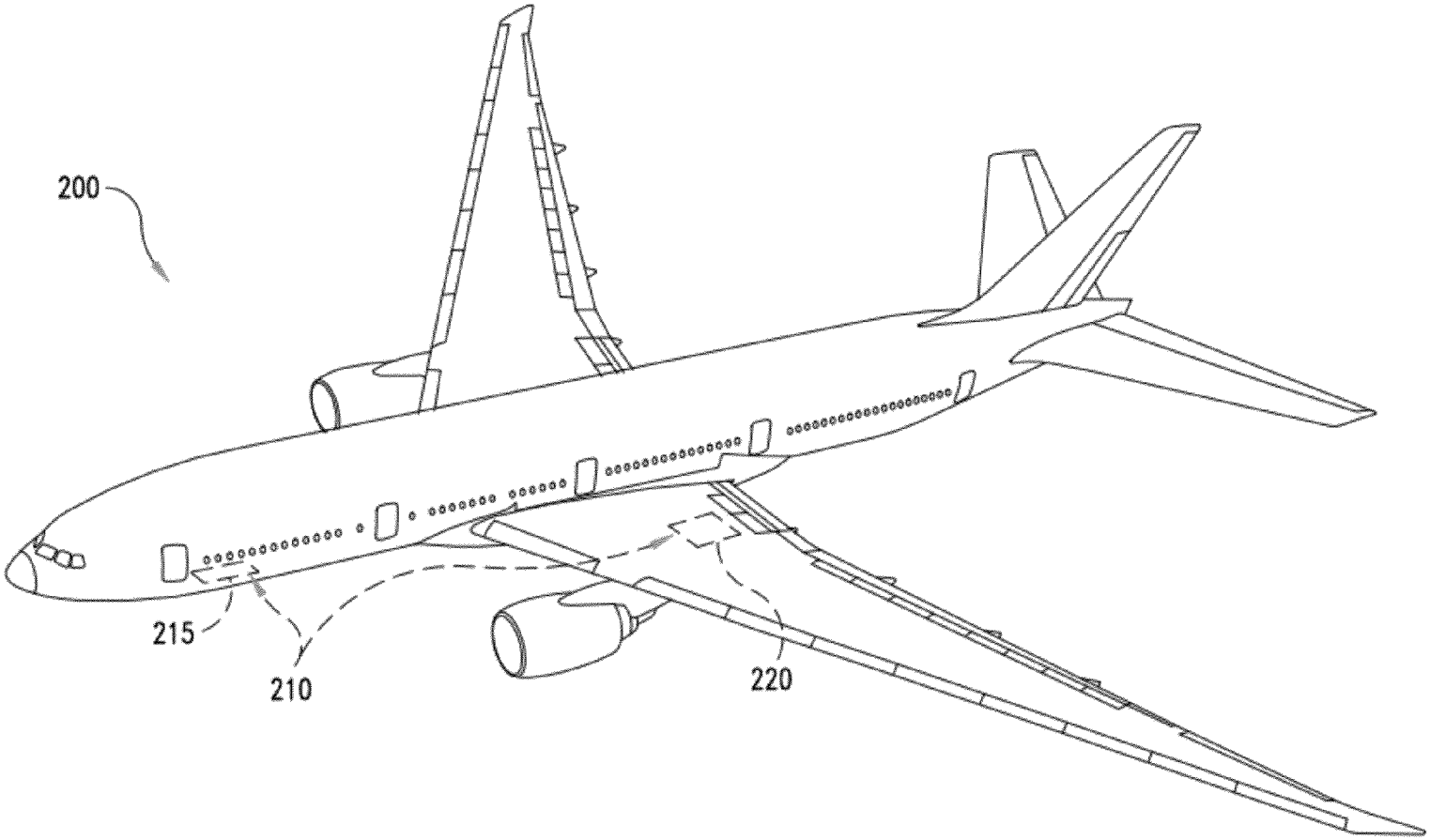
FIG. 5 is a perspective view of an airplane schematically illustrating one potential application for a titanium alloy structural member in accordance with an embodiment of the invention.

FIG. 5 schematically illustrates an aircraft 200 including structural members 210 manufactured in accordance with aspects of the invention. In this particular example, the structural members 210 are schematically indicated as elements of a front landing gear assembly 215 and a main landing gear assembly 220, but the structural members 210 may be used in any appropriate load-bearing capacity.

A method of manufacturing an aircraft in accordance with an embodiment includes forming a structural member and assembling the structural member into the aircraft. The structural member may be formed by forming a titanium-based alloy (e.g., an alloy comprising at least 50 wt. % Ti and at least 5 wt. % molybdenum) into a utile shape in any desired fashion, including casting or forging. This formed alloy may be subjected to a heat treatment process 100 generally as discussed above, e.g., by heating the formed alloy to a temperature above the alloy's beta transus temperature (heating process 110) and cooling to a second temperature below the beta transus temperature at a rate of no greater than 30° F./min (slow cooling process 120). In one embodiment, the alloy of the resultant structural member may have an ultimate tensile strength of at least about 140 ksi, e.g., 150 ksi or greater. The alloy may also have a $K_{1C}$ fracture toughness of at least about 50 ksi√in, e.g., 70 ksi√in If necessary, the heat treated structural member may be subjected to various post-forming operations, e.g., machining to provide the desired finish and final dimensions. The completed structural member may be assembled into the aircraft in any suitable fashion, e.g., bolting, welding, or any other known manner. Techniques for assembling structural members of aircraft are well known in the art and need not be detailed here.

The above-detailed embodiments of the invention are not intended to be exhaustive or to limit the invention to the precise form disclosed above. Specific embodiments of, and examples for, the invention are described above for illustrative purposes, but those skilled in the relevant art will recognize that various equivalent modifications are possible within the scope of the invention. For example, whereas steps are presented in a given order, alternative embodiments may perform steps in a different order. The various embodiments described herein can be combined to provide further embodiments.

Unless the context clearly requires otherwise, throughout the description and the claims, the words "comprise," "comprising," and the like are to be construed in an inclusive sense as opposed to an exclusive or exhaustive sense, i.e., in a sense of "including, but not limited to." Use of the word "or" in the claims in reference to a list of items is intended to cover a) any of the items in the list, b) all of the items in the list, and c) any combination of the items in the list.

In general, the terms used in the following claims should not be construed to limit the invention to the specific embodiments disclosed in the specification unless the above-detailed description explicitly defines such terms. While certain aspects of the invention are presented below in certain claim forms, the inventors contemplate various aspects of the invention in any number of claim forms. Accordingly, the inventors reserve the right to add additional claims after filing the application to pursue such additional claim forms for other aspects of the invention.

The invention claimed is:

1. A method of forming a metal member, comprising:

forming an alloy into a utile shape, the alloy consisting essentially of about 5 wt. % aluminum, about 5 wt. % molybdenum, about 5 wt. % vanadium, and about 3 wt. % chromium with the balance consisting of titanium; and cooling the alloy with the utile shape from a first temperature above a beta transus temperature of the alloy to a second temperature below the beta transus temperature at a cooling rate of no more than about 5° F./minute, wherein the second temperature is less than 700° F.

2. The method of claim 1 wherein the cooling rate is about 1° F./minute to about 5° F./minute.

3. The method of claim 1 wherein the cooling rate is a first cooling rate, the method further comprising cooling the alloy from the second temperature to room temperature at a second cooling rate that is faster than the first cooling rate.

4. The method of claim 1 further comprising cooling the alloy from the second temperature to room temperature.

5. The method of claim 1 wherein forming the alloy includes forming the alloy at a forming temperature below the beta transus temperature, and the method further includes heating the formed alloy to the first temperature.

6. The method of claim 1 further comprising, before cooling the alloy, casting the alloy at the first temperature above the beta transus temperature.

7. The method of claim 1, further comprising, after cooling the alloy to the second temperature, heat treating the alloy at a third temperature of about 700-1100° F. for about 1-12 hours.

8. A metal component, comprising:

a titanium alloy in a utile shape, the titanium alloy consisting essentially of about 5 wt. % aluminum, about 5 wt. % molybdenum, about 5 wt. % vanadium, and about 3 wt. % chromium with the balance consisting of titanium; and wherein a microstructure of the metal component comprises a beta phase and an acicular alpha phase in a basketweave pattern, and wherein the microstructure is generally free of grain boundary alpha phase as shown in FIG. 4.

9. The metal component of claim 8 wherein:

the titanium alloy has an ultimate tensile strength of about 150 ksi to about 175 ksi and a $K_{1C}$ fracture toughness of about 70 ksi√in to about 76.7 ksi√in.

10. The metal component of claim 8 wherein the metal component is a structural component for an airplane.

11. The metal component of claim 8 wherein the metal component is a cast component for an airplane.

12. The metal component of claim 8 wherein the titanium alloy has an ultimate tensile strength of about 150 ksi to about 175 ksi and a $K_{1C}$ fracture toughness of about 70 ksi√in to about 76.7 ksi√in.

13. A metal component, comprising:

a titanium alloy in a utile shape, the titanium alloy comprising at least about 50 wt. % titanium and at least about 5 wt. % molybdenum; and wherein a microstructure of the metal component comprises a beta phase and an acicular alpha phase having a basketweave structure, and wherein the microstructure is generally free of grain boundary alpha phase as shown in FIG. 4.

14. The metal component of claim 13 wherein titanium alloy consisting essentially of about 3 wt. % aluminum, about 15 wt. % molybdenum, and about 2.7 wt. % niobium with the balance consisting of titanium.

15. The metal component of claim 13 wherein titanium alloy consisting essentially of about 5 wt. % aluminum, about 5 wt. % molybdenum, about 5 wt. % vanadium, and about 3 wt. % chromium with the balance consisting of titanium.

16. The metal component of claim 15 wherein the titanium alloy has an ultimate tensile strength of about 150 ksi to about 175 ksi and a $K_{1C}$ fracture toughness of about 73 ksi√in to about 76.7 ksi√in.

* * * * *